US005447479A

United States Patent [19]

Gvoich

[11] Patent Number: 5,447,479

[45] Date of Patent: Sep. 5, 1995

[54] MOTOR-LESS EXERCISE TREADMILL WITH GEARED FLYWHEELS

[75] Inventor: Ned N. Gvoich, Beamsville, Canada

[73] Assignee: Kor-One, Tempe, Ariz.

[21] Appl. No.: 262,235

[22] Filed: Jun. 20, 1994

[51] Int. Cl.[6] ..... A63B 22/02

[52] U.S. Cl. ..... 482/54; 482/64

[58] Field of Search ..... 482/54, 51, 119, 70, 482/110, 63, 64

[56] References Cited

U.S. PATENT DOCUMENTS

| | | | |
|---|---|---|---|
| 3,637,206 | 1/1972 | Chickering, III | 482/54 |
| 4,151,988 | 5/1979 | Nabinger | 482/54 |
| 4,544,152 | 10/1985 | Taitel | 482/54 |
| 4,928,956 | 5/1990 | Chen | 482/54 |

*Primary Examiner*—Richard J. Apley
*Assistant Examiner*—Lynne A. Reichard
*Attorney, Agent, or Firm*—O'Connor, Cavanagh

[57] ABSTRACT

A motor-less exercise treadmill including a main frame comprising a pair of spaced side-rail members having a bracket mounted transversely at a front end thereof, a U-shaped tubular rail mounted on the bracket having a grasp-rail and a pair of height adjustable front legs so as to permit the raising or lowering of the front end of the main frame, a generally rectangular platform support frame mounted substantially along the length and intermediate the side-rail members, a generally planar slider bed mounted on the platform support frame intermediate the side-rail members, a front and rear roller journaled transversely generally at the front and rear ends of the side-rail members, a pair of static rear legs substantially horizontally suspending the main frame from the floor surface, a first flywheel rigidly connected to the front roller and adapted to form a first pulley having a first end of an endless belt entrained thereabout, a second end of the belt entrained about a smaller diameter second pulley mounted forward of the first pulley on the frame and rigidly connected by an axle to a second flywheel, the first flywheel rotates at a speed determined by a user walking or running on the tread-belt, the first pulley to second pulley gear ratio causes the second flywheel to rotate at a faster speed than the first flywheel generating a centrifugal force transmitted rearwardly through the axle to the second pulley and through the drive belt to the first flywheel and front roller to impart a control to the momentary response of the tread-belt in relation to the user increasing or decreasing his or her walking or running speed thereon.

9 Claims, 2 Drawing Sheets

MOTOR-LESS EXERCISE TREADMILL WITH GEARED FLYWHEELS

BACKGROUND OF THE INVENTION

1. Field of the Invention

This invention relates in general to exercise treadmills, and more particularly, to a motor-less exercise treadmill having a geared flywheel system to improve the momentary reaction of the tread-belt of the treadmill in response to a user increasing or decreasing his or her stride speed thereon.

For the fifth consecutive year, walking ranks No. 1 in growth among 40 sports and fitness activities surveyed by the National Sporting Goods Association. In 1992 treadmills were rated the largest selling fitness product with 9.3 million users.

2. Description Of The Related Art

In 1993 the motor-less treadmill was popularized by the television infomercial by such companies as Nordic Track of Minnesota and the La Fonda Group of California, models "Walk Fit" and "Walk To The Music" respectively, to name but a few.

These prior art devices are substantially similar in their design and their function. Generally, the prior art devices comprise a frame for mounting the components of the device which include; a front roller having one or more flywheels connected or integrally attached thereto; a back roller; a slider bed mounted on the frame intermediate the forward and back rollers; and a endless tread-belt entraining the front roller, slider bed and back roller to provide a revolving tread-belt that is manipulated into motion by the user while walking or running thereon.

The objective of these prior art devices is to provide an affordable and aerobic exercise effective indoor walking or running treadmill device whereon a user may walk or run while maintaining his or her body geographically stationary.

The failure of the prior art to provide an effective aerobic exercise treadmill device, is best illustrated with a brief description of the normal walking biomechanics.

There are three phases to normal walking; "the heel strike phase", wherein the advancing foot strikes the exercise surface with the heel which smoothly transitions to; the "foot flat phase", wherein the advancing foot moves backward, in relation to the torso, and the leg is fully extended with the entire sole of the foot in contact with the exercise surface which smoothly transitions to; the "push off phase", wherein the leg continues backward and the torso is propelled forward by the pushing off from the exercise surface with the big toe of the now trailing foot.

In order to generate a non-jarring, natural walking action, all three of the biomechanical phases of normal walking must occur in a coordinated transition, smoothly and without interruption, with the left and right legs reciprocating into and out from the three phases of walking.

The devices of the prior art do not provide the smooth transition of the three phases of normal walking due to their inefficient flywheel designs.

Walking on the tread-belt of the prior art devices demonstrates a sticking and binding of the tread-belt when the user's entire body weight is focused on the tread-belt during the "foot flat phase" of normal walking. The greater the user's weight the more demonstrable the sticking and binding of the tread-belt. The sticking and binding of the tread-belt relates to the inefficiency of the flywheel to deliver an effective inertia and momentum to the tread-belt. Sticking and binding of the tread-belt interrupts the smooth coordinated transition between the three phases of normal walking and thus predisposes the user's foot, knee, pelvis and lower spinal joints to injury. The risk of joint injury is substantially increased when the tread-belt sticks or stops abruptly thereby subjecting the knee joint, on the weight bearing side, to hyperextension strain which compromises the ligaments and hamstring muscles of the knee joint.

Furthermore, the flywheel design of the prior art fails to adequately control the tread-belt reaction in response to the user accelerating or decelerating his or her stride speed. This results in the tendency for the tread-belt to indiscriminately accelerate in response to the user pushing through the sticking point and during the push off phase of normal walking. The acceleration of the tread-belt being out of synchrony with the user's stride speed thus creating the potential for the user to fall forwardly.

Still a further drawback of the prior art devices relates to the inefficient tread-belt momentum supplied by the flywheel whereby the user is forced to stabilize his or her upper body by holding onto front stabilization rails, or in the case of the Nordic Track design by leaning into the a hip stabilizing pad, in order to manipulate the tread-belt into a smooth steady motion.

In order to overcome the inefficiencies of the flywheel design of the prior art a substantially larger and heavier flywheel would be required. A larger and heavier flywheel would generate a greater centrifugal force and thereby provide a greater inertia and momentum to the tread-belt. However, including a larger and heavier flywheel is prohibited by both the cost and the design parameters of the prior art devices.

All of the problems inherent to the prior art flywheel designs are overcome with a electric motor driven tread-belt since the speed of the tread-belt is in a direct relationship with the speed of the motor.

OBJECTS OF THE INVENTION

The motor-less treadmill of the present invention solves all of the problems inherent to the motor-less treadmills of the prior art. The invention includes a simple cost effective and design compatible modification to the flywheel systems of the prior art. This modification improves the efficacy of the prior art flywheel providing a control to the tread-belt of the device which vastly improves the momentary reaction of the tread-belt in response to the user changing his or her stride speed. The invention prevents sticking of the tread-belt in the foot flat phase of normal walking, substantially reduces the need for the user to brace his or her upper body against a supporting rail in order to manipulate the tread-belt into a smooth and steady motion and prevents the indiscriminate acceleration of the tread-belt out from under the user while still achieving the objectives of the prior art devices which, simply stated, is to provide an affordable and exercise effective motor-less treadmill device.

Objectives of the invention include providing a affordable, comfortable and effective indoor aerobic walking or running exercise treadmill.

A still further objective of the invention is to provide a motor-less treadmill that is economical to manufacture, easy to use, rugged, of simple construction and which has a long service life.

A further objective of the invention is to provide a motor-less treadmill having a tread-belt that is acutely responsive to the acceleration or the deceleration of the user's stride speed.

Yet a further objective of the invention is to provide a motor-less treadmill which may be elevated at it's forward end to thereby provide for an increase in the intensity of the exercise.

Another objective of the invention is to provide a motor-less treadmill that can provide a smooth coordinated operation, regardless of a users weight, thus providing an increased margin of safety to the user.

SUMMARY OF THE INVENTION

The objectives identified above, as well as other advantages and features of the invention are provided in a motor-less exercise treadmill which generally includes; a structural generally trihedral planar main frame which comprises a pair of side-rail members, a front mounting bracket and a generally rectangular platform support frame mounted intermediate the side-rail members; a generally planar slider bed is mounted on the platform support frame intermediate the side-rail members and between a pair of spaced rollers; a front and a rear roller which are journaled transversely at a front end and a rear end of the side-rail members of the main frame; an endless flexible tread-belt entrained about the rollers and over the slider bed; a first flywheel and first pulley arrangement connected by an endless elastomer drive belt to a second flywheel and second pulley arrangement; a U-shaped tubular rail having an upper U-shaped portion forming a grasp-rail, a left and right arm mounted forwardly on the front bracket of the main frame and terminating in left and right tubular ends; a pair of tubular front legs having a adjustability means for varying the height of the front end of the main frame and a pair of back legs suspending the rear of the main frame from the floor surface.

The left and right side-rail members extend generally lengthwise of the treadmill and are preferably formed of a suitable metal or plastic material extruded or stamped so as to provide an D-shaped channel member having a lateral wall, a medial wall, a top wall and a bottom wall. A sized and shaped slot is provided centrally on the medial walls at a rear end of the left and right side-rail members. A forward end of the left side-rail includes a sized bore aligned through the lateral and medial walls. The front bracket is preferably formed of a metal or plastic material and includes a upper flange and a lower flange which are bolted, screwed or otherwise rigidly connected to the top wall and the bottom wall of the left and right side-rails respectively, at the front end of the main frame. The front bracket includes a pair of spaced threaded plastic or metal bosses affixed to, or integrally formed in, a front wall of the bracket. The platform support frame comprises a substantially quadrangular plastic, metal or wood frame having a front member, a rear member and a pair of side members, the side members are bolted, screwed, welded, or otherwise rigidly affixed, along a length of the medial wall of the left and right side-rail members of the main frame and is of a length sufficient to substantially continuously support and retain the slider bed.

The slider bed comprises a wood, metal or plastic plank having a smooth upper surface and a bottom surface and is secured, by screws or bolts, at it's left and right edges, to the platform support frame to thereby dispose the upper surface of the slider bed immediately below a upper reach of the tread-belt. The slider bed is of a length sufficient to substantially continuously support the tread-belt between the rollers, and is of a width somewhat greater than the tread-belt width so that a inside edge of the side-rail members and a outside edge of the tread-belt is separated by an exposed edges of the slider bed. The exposed edges of the slider bed provide for the placement of the screws or bolts to secure the slider bed to the support frame and also prevent chaffing of the outside edges of the tread-belt with the inside edges of the side-rail members of the main frame.

The front and rear rollers are preferably formed of a plastic or metal hollow cylindrical tube. The front roller includes a left and a right fitted end cap having a conventional roller-bearing integrally formed, or rigidly affixed, at their centers. The end caps, including the roller-bearings, are press fit, glued, riveted or otherwise rigidly secured in a respective left and right open end of the front roller. A left and a right front roller mounting angle bracket includes a short shaft projecting substantially horizontally and medially from the center of the lower leaf of the bracket. The shafts are journaled in the roller-bearings mounted in the end caps of the front roller so that the front roller is free wheeling. A upper leaf of the roller mounting angle bracket is adapted to be bolted, welded or otherwise rigidly affixed forwardly on the top wall of the left and right side-rail members to thereby mount the front roller at the forward end of the main frame of the treadmill. The front roller is adapted to include a first flywheel integrally formed, or otherwise rigidly connected, to the left end of the roller. The rear roller includes a left and a right fitted end cap having a conventional roller-bearing integrally formed in, or otherwise rigidly affixed, at their centers. The end caps, including the roller-bearings, are press fit, glued, riveted, or otherwise rigidly secured, to a left and a right open end of the rear roller. The rear roller includes a long solid axle projecting substantially horizontally through the length of the rear roller and extending approximately one inch laterally to the left and right roller end caps to form a left and a right mounting shaft so that the rear roller is free wheeling. A threaded bore is provided in the left and right mounting shafts and the shafts are journaled within the slots provided at the rear end of the left and right side-rail members. A flat roller mounting bracket is sized and shaped to fit snugly against a left and right end of the left and right side-rail members. The mounting plate includes a threaded bore which engages an adjustment bolt. The adjustment bolt threads through the mounting plate to engage with the threaded bore of the left and right mounting shaft of the rear roller. The rear roller may be positionally adjusted to thereby loosen or tighten the tread-belt around the rollers of the treadmill by the simultaneous screwing or unscrewing of the adjustment bolt in a clockwise or counterclockwise direction, respectively.

The flexible, endless tread-belt is entrained around the front and rear rollers and passes freely over the length of the smooth upper surface of the slider bed. The tread-belt has a upper reach and a lower reach adapted for running or walking thereon.

A first end of the endless elastomer drive belt is entrained about the first flywheel and first pulley arrangement. The first flywheel is adapted to include a groove about its perimeter surface to form and function as a first pulley, generally referred to as the first flywheel and first pulley arrangement. A second end of the drive belt is entrained abut a second pulley which is mounted on the main frame forward of, and in direct alignment with, the first flywheel and first pulley arrangement. The second pulley is of a smaller diameter than the first flywheel and first pulley arrangement and is rigidly connected to an inside portion of an axle. The axle is mounted in a roller-bearing or bushing which is press fit within the bore provided through the lateral and medial walls of the forward end of the left side-rail member, forward of the first flywheel and first pulley arrangement. The axle passes freely through the roller-bearing and a second flywheel is rigidly connected to an outside portion of the axle. The second pulley, axle, roller-bearing and second flywheel comprise the second flywheel and second pulley arrangement.

The U-shaped tubular rail comprises a one-piece continuous bent metal or molded plastic tube including a substantially horizontal upper U-shaped portion which transitions laterally from the mid-line of the U-shaped portion to form a substantially vertical left and right tubular arm which terminate approximately four inches below the lower flange of the front bracket of the main frame as the left and right tubular ends. The left and right arms of the U-shaped tubular rail include a bore which is spaced approximately ten inches proximal to the free ends of the left and right tubular ends. These bores engage the respective left and right bosses, provided on the front bracket of the main frame and nut is threaded over the bosses to generally mount the tubular arms of the U-shaped tubular rail, in a spaced apart relation, to the front end of the main frame. The U-shaped portion of the U-shaped tubular rail is thus positionally retained approximately thirty-six inches upwardly from the upper flange of the front bracket of the main frame. A fifteen degree forward bend of the upper one-third of the left and right tubular arms positions the upper U-shaped portion of the U-shaped tubular rail forwardly to provide a grasp-rail which the user may grasp, at will, for stability. The grasp-rail may also serve for the attachment of various accessories, such as electronic diagnostic equipment and/or a audio tape player. The left and right tubular ends of the U-shaped tubular rail includes a bore spaced approximately three inches proximal to the free ends of the tubular ends so that the tubular ends project approximately four inches below the lower flange of the front bracket of the main frame with the bores within the tubular ends projecting approximately one inch below the lower flange of the lower bracket of the main frame.

The pair of adjustable tubular front legs comprise a left and right ten inch long metal or plastic tube of a smaller diameter than the diameter of the tubular ends of the tubular arms of the U-shaped tubular rail. The left and right front legs include a plurality of spaced bores in their sidewalls, along their lengths. A upper end of the left and right front legs is uniformly slidingly disposed within a bottom end of the left and right tubular ends respectively, so that a corresponding bore of the left and right front legs is aligned with the bores of the left and right tubular ends. The detachable pin is disposed through the bores of the tubular ends and the selected corresponding bores of the front legs to positionally retain and secure the front legs within the tubular ends at a uniform length. Adjustability to the height of the front legs is provided by the plurality of bores therein to permit the selective raising or lowering of the front end of the main frame and thereby a variation in the intensity of the exercise. A plastic or rubber foot is secured on a bottom end of the tubular legs to protect the floor surface.

The pair of back legs are preferably formed of a plastic, rubber or other suitable material and are affixed to the rear end of the main frame and are of a length sufficient so as to substantially horizontally support the main frame of the treadmill above the floor surface when the front legs are maximally disposed in the tubular ends to provide the lowest height setting to the front end of the main frame.

With a user walking or running on the tread-belt of the present invention the first flywheel and first pulley arrangement rotates in response to, and in direct relationship with, the speed of the tread-belt which is generated by the speed of the user's stride. The first flywheel and first pulley arrangement is connected by the drive belt to a second pulley, having a diameter four or five times smaller than the first flywheel and first pulley arrangement. The second pulley is connected to the second flywheel by the axle to form the second flywheel and second pulley arrangement. The geared down relationship of the second pulley to the first flywheel and first pulley arrangement causes the second flywheel to rotate at a faster speed than the first flywheel and first pulley arrangement. The faster rotating second flywheel generates a centrifugal force which is transmitted back through the drive belt to the first flywheel and first pulley arrangement to impart an effective influence to the inertia and momentum of the tread-belt of the treadmill device and thereby improve the momentary reaction response of the tread-belt in relation to a user increasing or decreasing his or her stride speed thereon. The user may vary the intensity of the exercise by either raising or lowering the front end of the main frame by adjusting the height of the front legs. A forward grasp-rail permits the user to stabilize his or her upper body and/or intermittently rest his or her arms as desired.

The modified flywheel arrangement of the present invention may be retro-fitted to the motor-less treadmills of the prior art by the mounting of the modified first flywheel and first pulley arrangement on the front roller and mounting the second flywheel and second pulley arrangement forward of, or rearward of the front roller, as the design of the prior art device permits.

Preferred embodiments of the invention, illustrative of the best modes in which applicants have contemplated applying the principles, are set forth in the following description and are shown in the drawings and are particularly and distinctly pointed out and set forth in the appended claims.

BRIEF DESCRIPTION OF THE DRAWINGS

Similar numerals refer to similar parts throughout the drawings.

DESCRIPTION OF THE PREFERRED EMBODIMENTS

Figure 1:
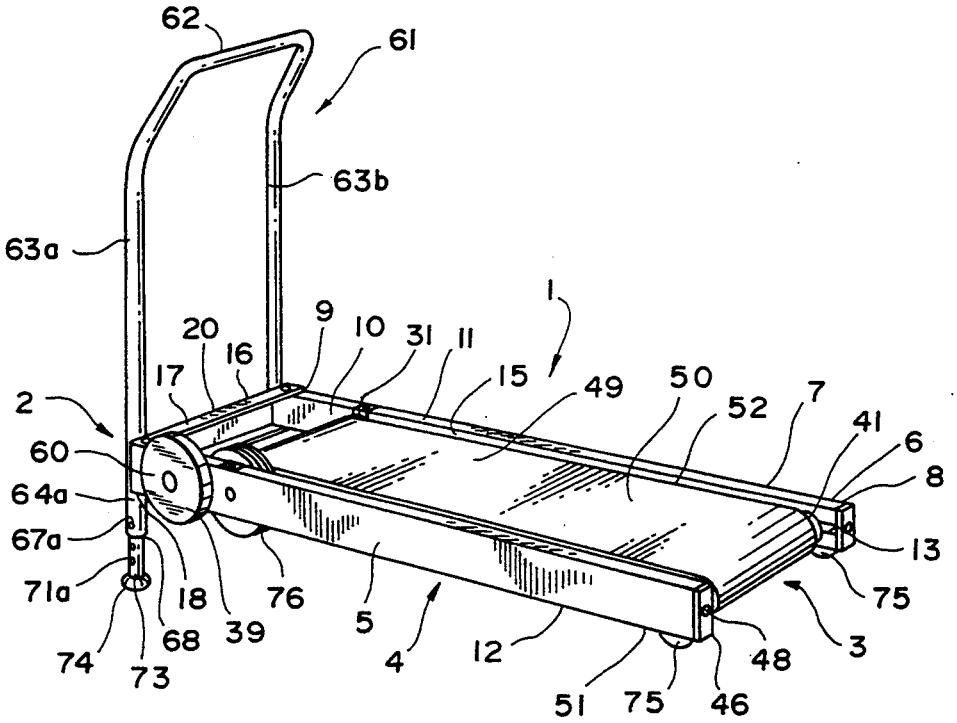
FIG. 1 is a left side perspective view of the exercise treadmill of the present invention.
Figure 2:
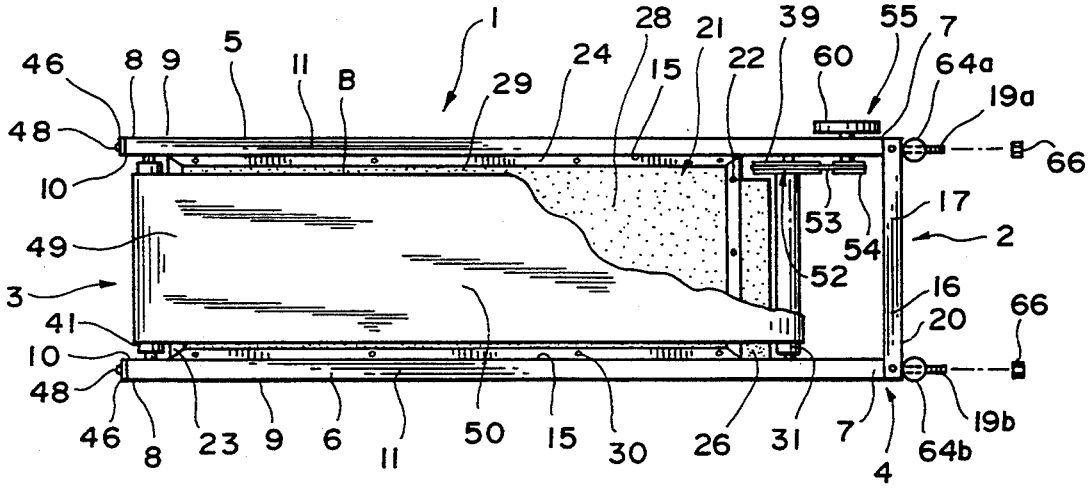
FIG. 2 is a top plan view of FIG. 1 illustrating the upper reach of the tread-belt cut away to further illustrate a slider bed and a platform support frame.

The treadmill assembly of the present invention is shown in FIG. 1 indicated generally at 1. Treadmill 1 is shown in greater detail in FIGS. 2–4. Referring first to FIGS. 1 and 2 it may be seen that treadmill assembly 1 has a front end 2 and a rear end 3 and generally includes as its main components; a substantially planar trihedral main frame indicated generally at 4 which comprises a left and a right side-rail 5 and 6, a front transverse mounting bracket 16 and a platform support frame 21 affixed transversely to the side-rails 5 and 6; a slider bed 26; a front roller 31; a rear roller 41; an endless tread-belt 49; a first flywheel and first pulley arrangement indicated generally at 52; a second flywheel and second pulley arrangement indicated generally at 55; a flexible endless drive belt 53; a one-piece U-shaped tubular rail indicated generally at 61 including a grasp-rail 62, a left and right tubular arm 63*a* and 63*b* respectively and left and right tubular ends 64*a* and 64*b* respectively; a pair of adjustable tubular front legs 70*a* and 70*b* and a pair of back legs 39.

Figure 3:
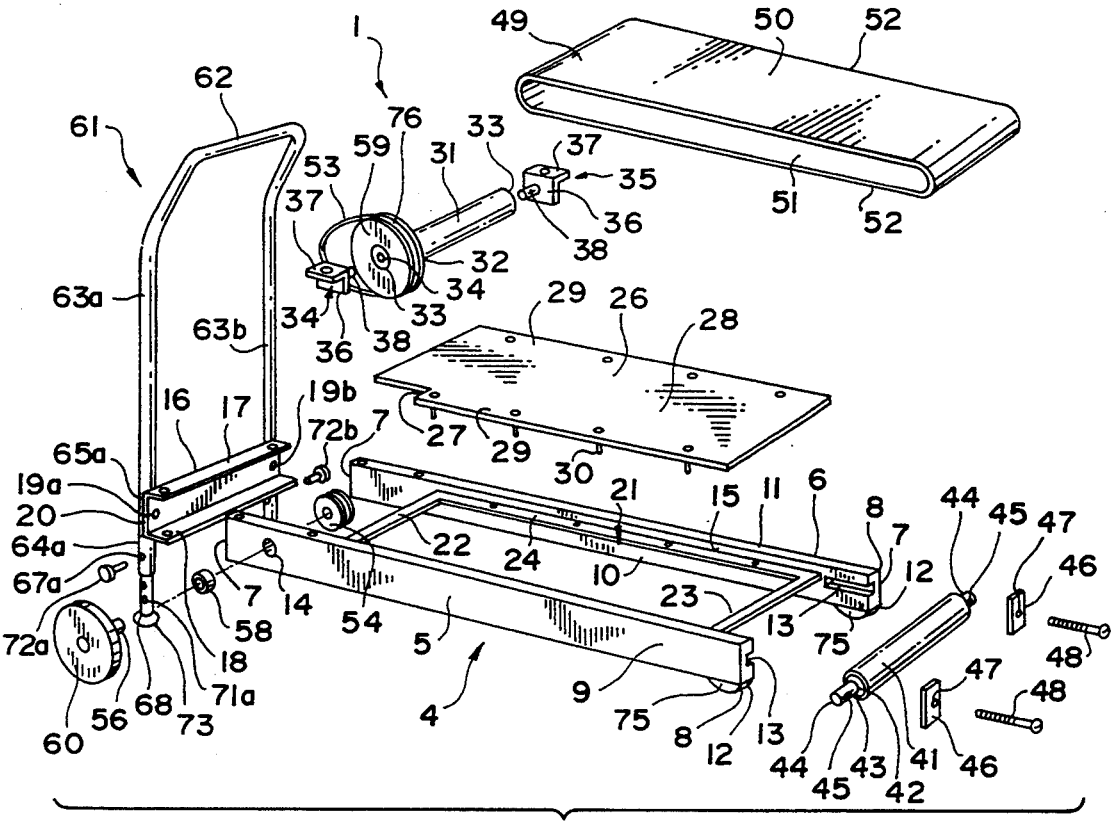
FIG. 3 is a left side perspective assembly view of the exercise treadmill with parts broken away for clarity, illustrating the components of the present invention.
Figure 4:
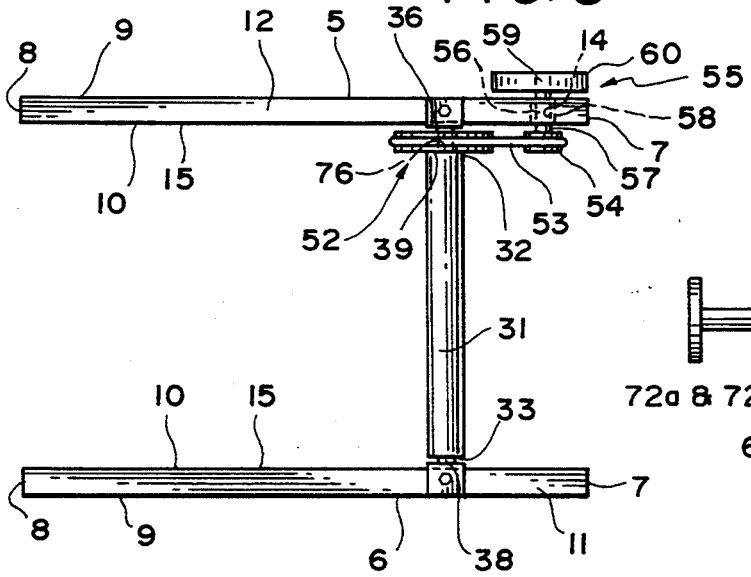
FIG. 4 is a top plan partial view of the forward main frame of the exercise treadmill illustrating the first flywheel and first pulley arrangement and the second flywheel and second pulley arrangement and FIG. 5 is an exploded perspective view of the front leg assembly.
Figure 5:
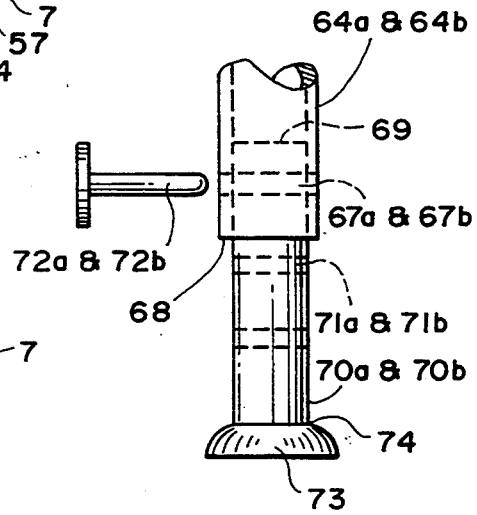

Referring now more particularly to FIGS. 2–4, it may be seen that the main frame 4 of treadmill 1 comprises a left and a right spaced side-rail 5 and 6 respectively, extending generally lengthwise of the treadmill 1. The side-rails 5 and 6 of the main frame 4 are formed as a hollow rectangular shaped channel member, preferably made of a suitable metal or plastic material extruded or stamped however, other suitable materials such as wood may be used. More specifically, the side-rails 5 and 6 include a front end 7, a rear end 8, a vertical lateral wall 9, a vertical medial wall 10, a top wall 11, and a lower wall 12. The medial walls 10 of the side-rails 5 and 6 include a central slot 13 which extends approximately six inches from the rear end 8 toward the front end 7 of the left and right side-rails 5 and 6. A bore is provided through the lateral wall 9 and the medial wall 10 spaced approximately six inches from the front end 7 of the left side-rail 5. Side-rails 5 and 6 are retained in a spaced apart relation at their front ends by the mounting bracket 16 having a top flange 17 and a bottom flange 18 which are screwed, bolted or otherwise rigidly connected transversely to the top walls 11 at the front end 7 of the side-rails 5 and 6. Side-rails 5 and 6 are further retained in a spaced apart relation, along their length, by the platform support frame 21 which includes a front end 22, a back end 23 and a left and right side 24. Sides 24 are bolted, welded or otherwise rigidly affixed along the length of the medial walls 10 of rails 5 and 6. Side-rails 5 and 6, bracket 16 and platform support frame 21 provide the main frame 4 with the platform support frame 21 positionally supporting and retaining the slider bed 26 in relation to the main frame 4. Mounting bracket 16 includes a left and right spaced threaded boss 19*a* and 19*b* respectively, which are bolted or welded to, or integrally formed in, a front wall 20 of the bracket 16 to generally mount, in a spaced apart relation, the left and right arms 63*a* and 63*b* respectively, of the U-shaped tubular rail 61 to the main frame 4.

The slider bed 26 substantially supports a upper reach 50 of the tread-belt 49 and is preferably formed of a stationary metal, wood or plastic plank having a length extending substantially between the front roller 31 and the rear roller 41. Slider bed 26 is preferably of a width somewhat greater than the width of the endless tread-belt 49 and extends out beyond a left and a right outer edge 52 of the tread-belt 49 with the outer edges 52 terminating short of a left and a right side edges 29 of the slider bed 26. A gap B is provided by the slider bed 26 between the outer edges 52 of the tread-belt 49 and a inner left and right edges 15 of the left and right side-rails 5 and 6 to thereby prevent a binding or rubbing of the edges 52 of the tread-belt 49 with the edges 15 of the side-rails 5 and 6. Slider bed 26 is secured by screws 30 to a top surface 25 of the side members 24 of the platform support frame 21. The slider bed 26 is maintained in close proximity to the upper reach 50 of the tread-belt 49 to thereby prevent sagging or yielding of the tread-belt 49 in response to the user walking or running thereon. Alternatively, the slider bed 26, the platform support frame 21, side-rails 5 and 6, and the bracket 16, or any combinations thereof, may be integrally formed as a unitary plastic injected member.

The front and rear rollers 31 and 41 respectively, are preferably formed of a plastic or metal hollow cylindrical tube. The front roller 31 includes a left and a right fitted end cap 33 having a conventional roller-bearing 34 integrally formed, or rigidly affixed, at their centers. The end caps 33, including the roller-bearings 34, are press fit, glued, riveted or otherwise rigidly secured in a respective left and right end 32*a* and 32*b* respectively, of the front roller 31. A left and a right front roller mounting angle bracket 34 and 35 respectively, includes a short shaft 38 which project substantially horizontally and medially from the center of the lower leaf 36 of the brackets 34 and 35. The shafts 38 are journaled in the roller-bearings 34 mounted in the end caps 33 of the front roller 31 so that the front roller 31 is free wheeling. A upper leaf 37 of the roller mounting angle brackets 34 and 35 is adapted to be bolted, welded or otherwise rigidly affixed forwardly on the top wall 11 of the left and right side-rail members 5 and 6 respectively, to thereby mount the front roller 31 near the front end 7 of the main frame 4 of the treadmill 1. The front roller 31 is adapted to include a first flywheel 39 integrally formed, or otherwise rigidly connected, to the left end 32 of the roller 31. The rear roller 41 includes a left and a right fitted end cap 42 having a conventional roller-bearing 43 integrally formed in, or otherwise rigidly affixed, at their centers. The end caps 42, including the roller-bearings 43, are press fit, glued, riveted, or otherwise rigidly secured, to a left and a right end 40*a* and 40*b* of the rear roller 41. The rear roller 41 includes a axle 44 projecting substantially horizontally through the length of the rear roller 41 and extending approximately one inch lateral to the left and right roller end caps 42 to form a left and a right mounting shaft 44' so that the rear roller 41 is free wheeling. A threaded bore 45 is provided in the left and right mounting shafts 44' and the shafts 44' are journaled within the slots 13 provided at the rear end 8 of the left and right side-rail members 5 and 6. A flat roller mounting plate 46 is sized and shaped to fit snugly against the left and right ends 8 of the left and right side-rail members 5 and 6. The mounting plate 46 includes a threaded bore 47 which engages an adjustment bolt 48. The adjustment bolt 48 threads through the bore 47 of the mounting plate 46 to engage with the threaded bore 45 of the left and right mounting shafts 44' of the rear roller 41. The rear roller 41 may be positionally adjusted to thereby loosen or tighten the tread-belt around the rollers of the treadmill by the simultaneous screwing or unscrewing of the adjustment bolt 48 in a clockwise or in a counter-clockwise direction, respectively.

The endless tread-belt 49 is preferably formed of a rubber, vinyl or other suitable flexible material and is entrained around the front and rear rollers 31 and 41 and includes an upper reach 50 and a lower reach 51. The upper reach 50 moves from front to rear so that a user standing on the upper operative surface of the upper reach 50 of the tread-belt 49 may walk or run in a forward direction, as indicated by arrow A of FIG. 3, and remain stationary relative to the main frame 4 of the treadmill 1.

Referring now more specifically to FIG. 4 it may be seen that the first flywheel and first pulley arrangement generally indicated at 52 includes a first flywheel 39 which is integrally formed, but may be otherwise rigidly connected to, the left end 32*a* of the front roller 31. The first flywheel 39 is preferably formed from a machined, cast or molded steel plate but may alternatively be formed of a sand filled vinyl casting or of any other suitable material having a weight substantially sufficient to function for the intended purpose of the flywheel. The first flywheel 39 includes a groove 76 about its perimeter so as to function as a flywheel and pulley in combination forming the first flywheel and first pulley arrangement indicated generally at 52. The flexible endless drive belt 53 is preferably formed from a flexible elastomer or rubber material and is entrained about the first flywheel and first pulley arrangement 52 and about a second pulley 54 of the second flywheel and second pulley arrangement 55. The second pulley 54 is formed preferably of metal or plastic materials and has a diameter four to five times smaller than the first flywheel and first pulley arrangement 52. Pulley 54 is rigidly connected to an inside projection 57 of the axle 56 and is positionally aligned with the first flywheel and first pulley arrangement 52 to thereby prevent excessive wear of the drive belt 53, or slippage of the drive belt 53 out from the first flywheel and first pulley arrangement 52 and/or out from the second pulley 54 during use of the device. The axle 56 is preferably formed of a metal or plastic material and is retained in a bushing 58 which is press fit or otherwise rigidly affixed in the bore 14 provided through the lateral and medial walls 9 and 10 respectively, near the front end 7, forward of the first flywheel and first pulley arrangement 52, of the left side rail 5 of the main frame 4. The axle 56 passes through the bushing 58 to form an outside projection 59 of the axle 55 having the second flywheel 60 rigidly connected thereto. The second flywheel 60 is of a similar construction to flywheel 39.

The U-shaped tubular rail 61 is formed from a one-piece bent metal or molded plastic tube and includes; a substantially horizontal upper U-shaped portion which forms the grasp-rail 62 centrally and extending peripherally to form the left and right arms 63*a* and 63*b* respectively which terminate in the left and right tubular ends 64*a* and 64*b* respectively. The left and a right tubular arms 63*a* and 63*b* include a bore 65*a* and 65*b* respectively, through their respective sidewalls. Bores 65*a* and 65*b* are spaced approximately ten inches proximal to the free ends of the left and right tubular ends 64*a* and 64*b* of rail 61. Bores 65*a* and 65*b* align and engage with the respective bosses 19*a* and 19*b* provided on the front wall 20 of bracket 16 to generally mount the left and right arms 63*a* and 63*b* of U-shaped rail 61, in a spaced apart relation, to the bracket 16 at the front end 2 of the treadmill 1. Nuts 66 are threaded on bosses 19*a* and 19*b* and tightened against the arms 63*a* and 63*b* to positionally retain U-shaped rail 61 on bracket 16 at the front end 2 of the main frame 4 of the treadmill 1. U-shaped rail 61 extends approximately thirty-six inches upwardly from the upper edge of bracket 16 at the front end 4 of the treadmill 1 providing the user with the grasp-rail 62 for stability. Bores 67*a* and 67*b* are provided in the respective sidewalls of the tubular ends 64*a* and 64*b* spaced approximately five inches proximal to the free ends of the tubular ends 64*a* and 64*b* of rail 61. With rail 61 mounted on bracket 16 the tubular ends 64*a* and 64*b* project approximately four inches below the lower edge of the bracket 16 of the main frame 4 and bores 67*a* and 67*b* project approximately one inch below the lower edge of the bracket 16 of the main frame 4. A bottom end 68 of the tubular ends 64*a* and 64*b* slidingly receives a top end 69 of the tubular front legs 70*a* and 70*b* respectively. The tubular front legs 70*a* and 70*b* having a overall length of approximately ten inches and formed of a plastic or metal tube of a smaller diameter than the diameter of the tubular ends 64*a* and 64*b* of the rail 61.

Tubular front legs 70*a* and 70*b* include a plurality of spaced bores 71*a* and 71*b* through their respective sidewalls, along their respective length. The tubular front legs 70*a* and 70*b* and tubular ends 64*a* and 64*b* are uniformly secured and retained, with respect to each other respectively, by the alignment of the bore 67*a* of the left tubular end 64*a* with one of the bores 71*a* of left tubular leg 70*a* and by aligning bore 67*b* of the right tubular end 64*b* with the matching bore 71*b* of right tubular leg 70*b* having a detachable pin 72*a* and 72*b* disposed respectively, therethrough. Legs 70*a* and 70*b* are uniformly raised or lowered by selecting a particular matching bore 71*a* and 71*b* provided in each of the front legs 70*a* and 70*b* and aligning the selected bores 71*a* and 71*b* with the bores 67*a* and 67*b* and securing their alignment with the pins 72*a* and 72*b* to thereby selectively raise or lower the front end 4 of treadmill 1 to increase or decrease the intensity of the exercise as desired.

A plastic or rubber foot 73 is press-fit or otherwise attached to a bottom end 74 of legs 70*a* and 70*b* to protect the floor surface. A pair of static plastic or rubber back legs 75 are screwed, bolted, glued or otherwise rigidly connected to the lower wall 12 of the left and right side-rails 5 and 6 at the rear end 8 of the side-rails 5 and 6 of the treadmill 1. Back legs 75 and are of a sufficient height so as to ensure that the main frame 4 is substantially horizontally supported above the floor when the front legs 70*a* and 70*b* are maximally disposed within the tubular ends 64*a* and 64*b* and the front end 4 of the treadmill 1 so that the frame 4 is supported at its lowest height, as best illustrated in FIG. 1.

During operation of the treadmill 1 the user manipulates the tread-belt 49 into a front to back motion by walking or running on the upper reach 50 of the tread-belt 49. The front to back movement of the tread-belt 49 causes the front roller 31 and the first flywheel and first pulley arrangement 52 to rotate in a clockwise direction. The second pulley 54, having a diameter smaller than the first flywheel and first pulley arrangement 52, connected thereto by the drive belt 53, and further connected by the axle 56 to the second flywheel 60 causes the second flywheel 60 to rotate at a faster speed than the first flywheel and first pulley arrangement 52 rotates. The faster rotating second flywheel 60 generates a centrifugal force which is transmitted back through the first flywheel and first pulley arrangement 52 to impart a controlled inertia and momentum to the tread-belt 49, thereby improving the momentary reaction of the tread-belt 49 in response to a user increasing or decreasing his or her stride speed thereon.

In the foregoing description, certain terms have been used for brevity, clearness and understanding; but no unnecessary limitations are to be implied therefrom beyond the requirement of the prior art, because such terms are used for descriptive purposes and are intended to be broadly construed. Moreover, the description and illustration of the invention is by way of example, and the scope of the invention is not limited to the exact details shown or described. Having now described the features, discoveries and principles of the invention, the manner in which the improved treadmill assembly is constructed and used, the characteristics of the construction, and the advantageous, new and useful results obtained; the new and useful structures, devices, elements, arrangements, parts and combinations, are set forth in the appended claims.

What is claimed is:

1. An exercise treadmill having a main frame, said main frame comprising a pair of spaced side-rail members extending generally lengthwise of said treadmill, and said main frame further comprising a front bracket secured transversely to said side-rails at a front end of said side-rails, and a platform support frame having a front end, a back end and a left and a right side, with said left and right sides secured to said side-rails at an inside wall, a belt system including forward and rear rollers journaled generally transversely on said side-rails of said main frame and an endless belt placed about said rollers, said belt having an upwardly exposed upper reach and a lower reach.

a belt support slider bed structure supported on said platform support frame and having a smooth upper surface, a forward and a rear end and a left and a right side, said platform structure substantially underlying said upper reach of said belt, a pair of adjustable front legs adapted to provide for the elevating or lowering a forward end of said main frame, a pair of static rear legs, a first flywheel rigidly connected, or integrally formed with, said front roller of said belt system, said first flywheel including a groove about a perimeter of said first flywheel so as to provide said first flywheel and a first pulley in combination, a elastomeric endless drive belt having a first end entrained about said groove of said first pulley of said first flywheel, and a second end of said drive belt entrains about a second pulley of a smaller diameter than said first pulley of said first flywheel, and said second pulley having an axle connecting said second pulley with a second flywheel.

2. The treadmill as set forth in claim 1 wherein each of said side-rail members is generally channel-shaped in cross section, having a generally vertical lateral and medial web connected at a top and a bottom by a generally horizontal web.

3. The treadmill as set forth in claim 2 wherein said front bracket includes a upper flange and a lower flange adapted to be secured transversely to said side-rails at a front end of said side-rails.

4. The treadmill as set forth in claim 2 wherein said platform support frame having a front end, a back end and a left and a right side, with said left and right sides secured to said side-rails, is preferably formed of wood or plastics having at least one side smoothly finished.

5. The treadmill as set forth in claim 2 wherein said adjustable front legs include a lower tube telescopingly connected to a upper tube and adapted to be selectively secured, with respect to said upper tube, at a variable length so as to provide said adjustability of said height of said forward end of said main frame.

6. The treadmill as set forth in claim 2 wherein said pair of static rear legs include a one-piece rubber or plastic pod secured at a rear end of said main frame, and having a height sufficient so as to support said rear end of said main frame substantially horizontally above the floor surface when said front legs are adjusted to support said main frame at a maximum and at a minimum height.

7. The treadmill as set forth in claim 2 wherein said forward roller of said belt system includes said first flywheel rigidly connected to, or integrally formed at, one end of said forward roller.

8. The treadmill as set forth in claim 2 wherein said rear roller of said belt system includes a means for positionally adjusting said rear roller relative to said front roller so as to vary a tension of said belt of said belt system.

9. The treadmill as set forth in claim 2 wherein said drive belt entrains about said first flywheel, and said second pulley, said second pulley having a smaller diameter than said first flywheel and said first pulley in combination, and said second pulley having a rigid connection with said second flywheel.

* * * * *